United States Patent [19]

Stone

[11] 4,314,634

[45] Feb. 9, 1982

[54] RETURNABLE CONTAINER HAVING A CENTRAL PARTITION FORMING A RETURN HANDLE

[75] Inventor: Orison W. Stone, New Haven, Vt.

[73] Assignee: Pack Image, Inc., Middlebury, Vt.

[21] Appl. No.: 126,690

[22] Filed: Mar. 3, 1980

[51] Int. Cl.[3] ..... B65D 5/02

[52] U.S. Cl. ..... 206/167; 206/189; 206/427; 229/52 B

[58] Field of Search ..... 206/167, 147, 180, 184, 206/189, 427, 149; 229/45 R, 52 B

[56] References Cited

U.S. PATENT DOCUMENTS

| | | | |
|---|---|---|---|
| Re. 29,063 | 12/1976 | Graser . | |
| 2,637,480 | 5/1953 | Forrer | 206/167 |
| 2,783,916 | 3/1957 | Hadajy | 206/167 |
| 2,899,104 | 8/1959 | Callura | 206/149 |
| 3,111,241 | 11/1963 | Engel | 206/180 |
| 3,176,902 | 4/1965 | Champlin | 206/140 |
| 3,255,919 | 6/1966 | Koolnis . | |
| 3,331,531 | 7/1967 | Spery | 206/149 |
| 3,977,518 | 8/1976 | Arneson . | |
| 4,034,852 | 12/1977 | Forrer . | |

*Primary Examiner*—Herbert F. Ross

*Attorney, Agent, or Firm*—Wood, Herron & Evans

[57] ABSTRACT

A returnable container for bottles. The container is formed as a tube having interconnected bottom, end and top walls. Bottles are side loaded into the tube and thereafter upper and lower side flaps on both sides of the container close the container around the bottles. A single thickness central partition is connected to at least two walls, e.g., an end wall and the bottom wall. The top wall is perforated so that substantially the entire portion of the top wall can be torn away to expose the bottle within. After the contents of the bottle have been consumed, they may be returned to the container and carried, by means of the central partition, back to the store where they were originally purchased.

15 Claims, 15 Drawing Figures

RETURNABLE CONTAINER HAVING A CENTRAL PARTITION FORMING A RETURN HANDLE

This invention relates to a container for bottles, and more particularly, to a container which substantially completely encloses the bottles.

In U.S. Pat. No. 3,090,520, there is disclosed a container for six bottles. The container consists of a tube formed by a bottom wall, a top wall and two end walls. Bottles are side loaded into the tube, and then upper and lower side flaps are brought around the bottles to completely enclose the bottles except for the bottle crowns and caps which project throughout apertures in the top wall.

This type of container has been in use for many years and is particularly useful in packaging a beverage which should not be exposed to light over a very long period as, for example, beer which is contained in clear bottles.

Access to the bottles is usually attained by pulling up on the upper side flap. In the normal course of opening the container, the structural integrity of the container is destroyed. The container thus is not really useful as a container for returnable bottles.

Over the past few years, for ecological reasons, there has been a greater emphasis on returning bottles after they have been emptied of their contents. A number of states have even passed laws preventing the sale of beverages in non-returnable or one-way bottles. To the extent that returnable bottles are sold in the container described above, the container presents a problem. Since removal of the bottles from the container, for all practical purposes, requires the destruction of the container, the bottles must be returned in another type of container as, for example, a paper bag. The consumer, who is used to carrying his returnable bottles in the basket-type container in which they are usually sold, may be reluctant to buy a product in a container which is not as useful as other products having returnable containers.

In copending application Ser. No. 58,850, filed July 19, 1979, now U.S. Pat. No. 4,256,226 there is disclosed a returnable container which substantially entirely encloses a group of six bottles. The top wall has an internal channel-shaped brace glued to it, the channel-shaped brace extending downwardly into the central portion of the container. The bottles are removed by tearing away portions of the side walls to remove the bottles while leaving the center portion of the top wall and central brace intact. That center portion of the top wall and the center brace cooperate to retain the integrity of the container so that empty bottles can be returned to the container and the container can be carried by the central brace back to the store.

An objective of the present invention has been to provide a returnable container of generally the type described in U.S. Pat. No. 4,256,226, but differing therefrom in several respects. For example, in the present invention the central portion of the container can be torn away to expose bottles on both sides of the center partition.

Another objective of the invention has been to provide a returnable container which uses a minimum amount of paperboard in its formation.

Still another objective of the invention has been to provide a returnable container which is adapted to be run on conventional side loading machinery of the type disclosed in U.S. Pat. No. 3,225,510.

These and other objectives of the invention are attained by providing a returnable container formed as a tube having interconnected bottom, top and end walls with a center partition disposed below the top wall and extending between the two end walls. Preferably, the center partition is connected to the bottom and end walls, although it performs satisfactorily if connected to only one end wall, or to both end walls and not the bottom wall.

The central partition underlies the top wall and can be spaced from it by an inch or so. Other than a separator between the bottles, the central partition performs no function as the full bottles are carried from the store to the consumer. When the top wall is torn away along perforation lines provided for that purpose, the central partition is exposed. Empty bottles can be placed in the container alongside the central partition, which at that stage is in the form of a basket type container. Holes are provided in the central partition by which it can be gripped to serve as a handle for carrying the returnable bottles back to the store.

The bottom wall has upwardly-projecting tabs to which a lower edge of the central partition is glued. The combination of upwardly-projecting tabs and lower edge of the central partition form a double thickness of paperboard which keeps the adjacent bottles separated as is required by I.C.C. regulations.

Another feature of the invention has been to provide, optionally, small corner webs at the top four corners of the container which remain after the center portion of the top wall has been removed along its perforation line. Those corner webs interconnect the side and end walls and thereby maintain the original form of the container even after the major portion of the top wall has been removed to permit the removal of the bottles.

This feature, as indicated, is optional and can be eliminated if there is an overriding need to be able to turn the container upside down to dump out the returned bottles at the brewery.

Tubular containers having a central divider are well known. In such containers, the central divider lies parallel to two opposed walls such as the top and bottom wall. The present invention is believed to be unique in providing a tubular container wherein a single thickness central divider lies perpendicular to all four walls, that is, the bottom, top and end walls, and lies generally parallel to the side walls after they have been closed around the product contained therein.

Another feature of the invention has been the providing of a one-piece blank which can be folded and glued on standard, straight line, untimed gluers into a flat-folded blank with a central partition, the blank being suitable for running on the machine of U.S. Pat. No. 3,225,510.

The one-piece blank has, in interconnected serial relation, an upper portion of an end wall, a top wall, an end wall, a bottom wall and a lower portion of an end wall. Attached to the lower portion of the end wall and projecting generally laterally therefrom along a hinge line is a panel forming a central partition. That panel has a diagonal crease. After the blank described has been cut from a web of paperboard, the projecting section of the central partition is folded along the diagonal crease upon the other section, and the lower portion of the end wall is thus folded onto the bottom wall. Glue having previously been applied to an edge of the projecting section, that edge adheres to the tabs in the bottom wall. In this manner, the central partition is interconnected between the lower portion of the end wall and the bottom wall and folded flat. When the lower portion of the end wall is swung upwardly to a position at 90° to the bottom wall, the center partition, previously folded along the diagonal crease, is unfolded and will stand substantially vertically and perpendicular to the bottom and end walls.

After the lower portion of the end wall is folded over onto the bottom wall as described, glue is then applied to an edge of an upper portion. The upper portion of the end wall is folded onto and glued to the lower portion of the end wall by folding along a crease between the top and end walls. In that fashion, the flat-folded blank is completely formed ready to be run on a machine of U.S. Pat. No. 3,225,510.

The flat blanks are adapted to be laid out with alternate blanks having their orientation reversed so that the projecting section of the central partition can be cut from the board adjacent the upper portion of the end wall where excess board exists. Through this reversal and nesting, a substantial saving in board is realized.

The bottom wall of the container of the present invention may be formed with double tabs struck from and placed up from the bottom wall all as disclosed in U.S. Pat. No. 3,176,902. Those tabs have relatively sharp edges which have a tendency to scrape and mar the labels on the bottles which are side loaded into the container.

Another feature of the present invention resides in the elimination of this label scraping problem by providing a new type of double thickness tab struck from the bottom wall and projecting upwardly from the bottom wall. In accordance with the present invention, each tab to be located between adjacent bottles is creased along a center line and is hinged along another line to the bottom wall. In running through the side loading machine, the tabs are pushed slightly upwardly out of the plane of the bottom wall into an inverted V. Simultaneously, bottles are slid onto the bottom wall by the side loading mechanism. The bottom portion of each bottle engages the slightly upward-projecting tabs and simultaneously swings each tab up to a substantially vertical position out of the plane of the bottom wall while bending the free portion of the tab along its crease in a downward direction. In this way, the double thickness of separation between the adjacent bottles is provided, but at no time is a bottle subjected to the relatively sharp corner of an upwardly-projecting tab as the bottle is loaded into the container.

The several features of the invention will become more readily apparent from the following detailed description taken in conjunction with the accompanying drawings in which.

Figure 1:
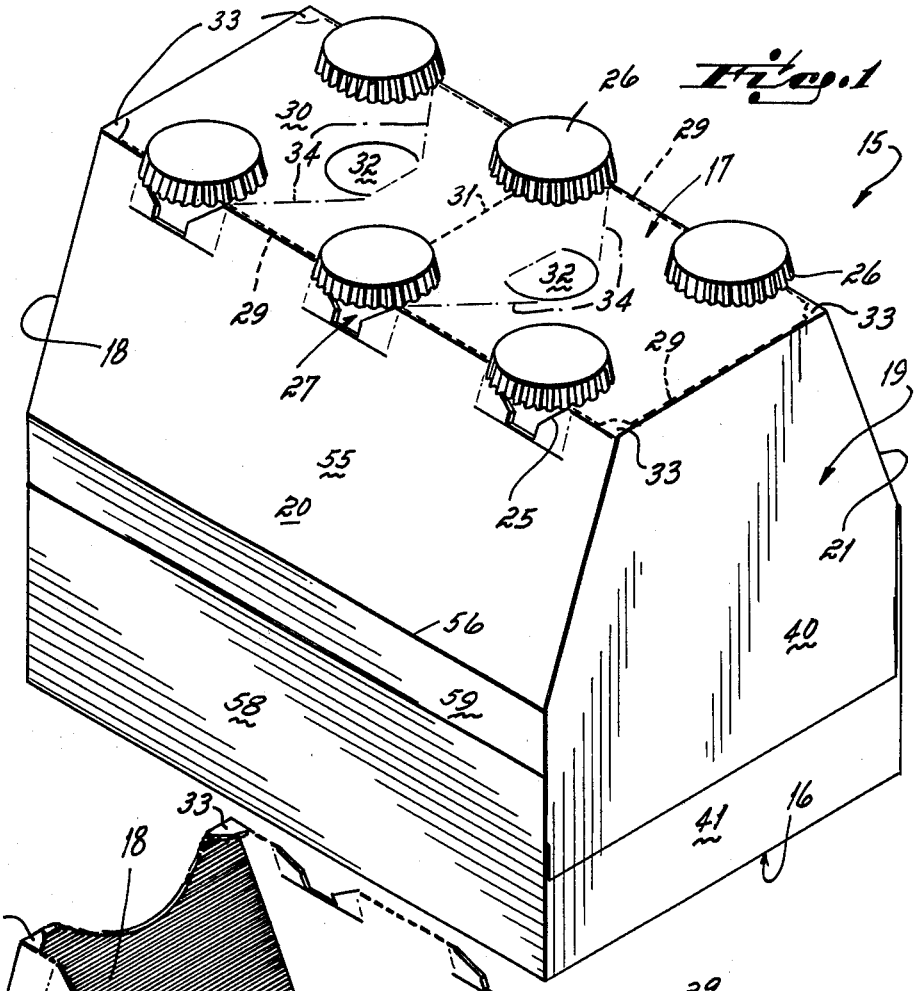
FIG. 1 is a perspective view of the container of the present invention closing around six bottles.
Figure 2:
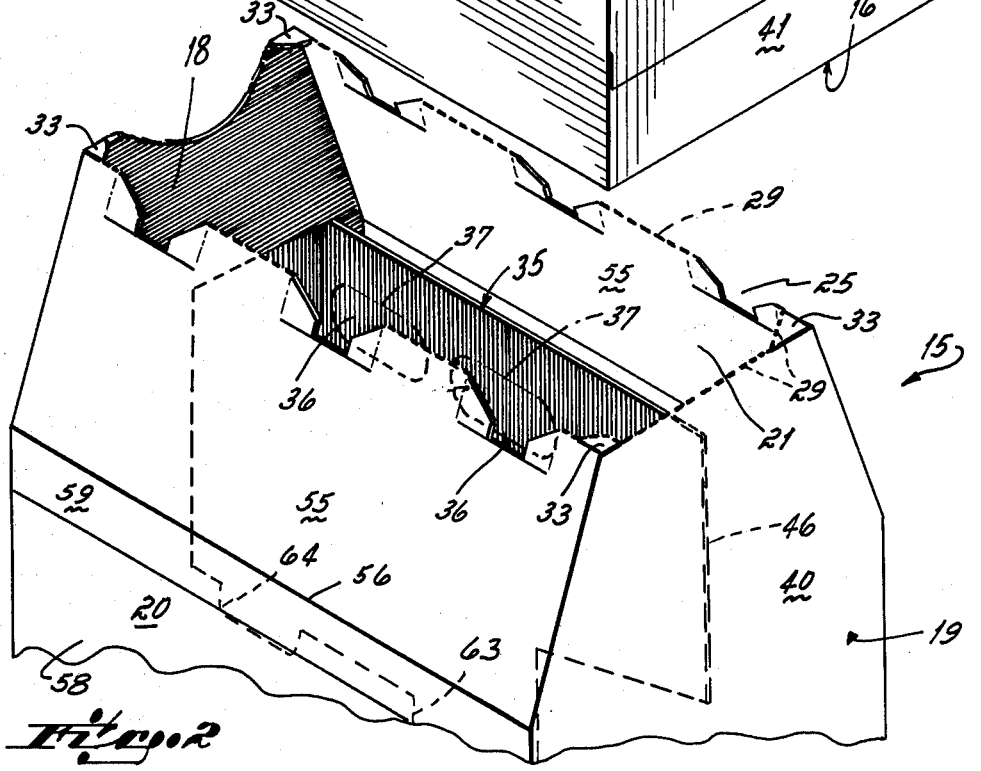
FIG. 2 is a fragmentary perspective view of the same container with the top portion torn away and the bottles removed.

The container of the present invention is shown at 15 in FIG. 1. It has a bottom wall 16, a top wall 17, end walls 18 and 19 and side walls 20 and 21. The top wall 17 and upper edge of the side walls 20, 21 have six openings 25 through which the upper ends 26 of bottles 27 project. The openings 25 are formed generally as described in U.S. Pat. No. 3,090,520, those openings being provided along the joint between the top wall and the side walls in order to permit the side loading operation which is described in that U.S Pat. No. 3,090,520 as well as U.S. Pat. No. 3,176,902. The top wall has perforations 29 which define a center portion 30 of the top wall around its perimeter which permits that center portion to be grasped and torn off the remainder of the container so that the container will appear generally as shown in FIG. 2. The top wall also has a transverse perforation 31 which is useful in the event that it is desired to open only a portion of the container. The top wall also has two partially cut tabs 32 which define two finger holes by which the container is grasped when the container is full of filled bottles so that the container can conveniently be carried from the store to the place of consumption.

Finally, the top wall has two sets of V-shaped creases 34 which extend from the openings 25 to the finger holes 32. The diagonal creases 34 tend to impart strength to the center portion 30 of the top wall 17 and reduce a tendency to tear into the center portion as contrasted to tearing along the perforation line 29 provided for that purpose. As the tear is begun at the left-hand end of the container, the creases tend to cause the central portion 30 to bow inwardly, thereby forming a sort of truss which strengthens the center portion and forces the tear to take place along the perforation line 29.

Within the container and located at its center is a central partition 35 which is secured to the bottom wall 16 and which extends between the end walls 18 and 19. The partition 35 should be connected to at least two walls as, for example, end wall 19 and bottom wall 16, or the two end walls 18 and 19. Preferably, it is connected to the opposed end walls 18 and 19 and the bottom wall 16. It can be seen from FIG. 2 that when the center portion 30 of the top wall is removed, all of the bottles can be removed from the container. By the same token, when emptied, all of the bottles can be replaced in the container and the center partition can be used as a handle for carrying the empties as in a basket type carrier back to the store. For this purpose, two tabs 36 are preferably cut from the upper portion of the central partition 35, the tabs being hinged along their upper edges 37 to leave a pair of finger holes.

The perforations 29 may be such as to leave small corner portions 33 interconnecting the end and side walls when the central portion 30 is removed. This is an optional feature which, when the center portion 30 of the top is removed, maintains the form of the container. Alternatively, those corner members 33 could be removed and the upper portions of the side walls could flop away from the end walls which facilitates the emptying of the container at the brewery.

Figures 3, 3A, 4:
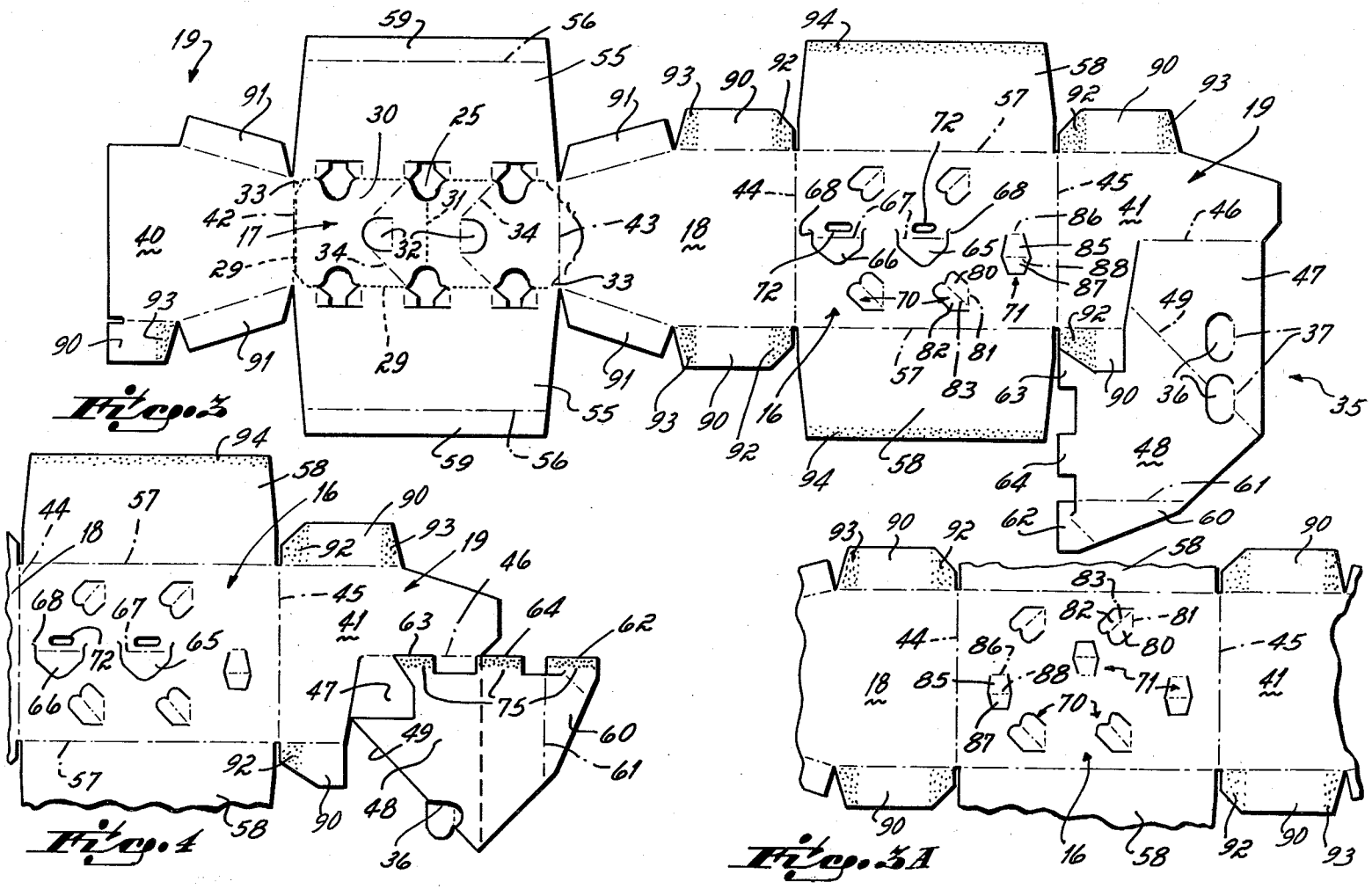
FIG. 3 is a plan view of a one-piece blank from which the container is formed.
FIG. 3A is a fragmentary view of an alternative form of the bottom wall.
FIG. 4 is a fragmentary plan view of the blank illustrating a first step in the forming of the container.

The container is formed from a blank illustrated in FIG. 3. The blank has the following elements serially interconnected: an upper portion 40 of end wall 19, top wall 17, end wall 18, bottom wall 16 and a lower portion 41 of end wall 19. The foregoing elements are hinged along fold lines or creases 42, 43, 44 and 45, respectively.

The top wall 17 has upper side flaps 55 hinged to it along a portion of the perforation 29. The extreme edge portion of each upper side flap is scored or cut as at 56 to "take the fight out of the board" and permit a softer fold when the container is completed after being loaded with the bottles.

The bottom wall 16 has hinged to it along crease or fold lines 57 a pair of lower side flaps 58. After the container is loaded with bottles, the lower side flaps will be glued to the upper side flaps along the edge portions 59 delineated by the scores 56 to form the two side walls 20 and 21.

The central partition 35 is hinged along a crease or fold line 46 to the bottom portion 41 of end wall 19. The crease 46 is perpendicular to the creases 42–45.

The central partition 35 is formed as a first section 47 which is connected at the crease 46 to bottom portion 41, and a second section 48 which is joined to the first section along a diagonal crease or fold line 49. The crease 49 preferably lies at 45° to the creases 46 and 42–45.

It can be seen from FIG. 3 that the second section 48 of the central partition 35 projects transversely beyond the extremity of the lower and upper side flaps 58 and 55, respectively. Part of the projecting portion consists of an optional glue flap 60 joined by crease or fold line 61 to the second section 48. That glue flap includes a tab 62 which is to be glued to the end wall 18 to add additional structural integrity to the container if desired.

The second section 48 also has glue tabs 63 and 64. These glue tabs will match up respectively with bottom glue tabs 65 and 66 to secure the central partition 35 to the bottom wall. The tabs 65 and 66 are connected along creases or fold lines 67 to the bottom wall. The cut line which defines and forms the tabs 65, 66 extends past the creases 67 about ¼ inch as indicated at 68. This extension of the tabs 65, 66 past the crease 67 which is at the center line of the bottom wall minimizes the possibility of tearing when the juncture of the tabs and bottom wall is stressed by supporting the container and contents by the central partition and hence the tabs 65, 66. In actuality, the bottles are able to participate in the supporting function to keep the stress from extending substantially beyond the cuts 68.

The bottom wall also has transverse divider tabs 70 to be located between adjacent bottles on each side of the container and a longitudinal divider tab 71 to be located between bottles on opposite sides of the center line. The manner in which the divider tabs function will be explained below.

The bottom wall also has two apertures 72 which are formed simply to facilitate the running of the container on existing machines of the type disclosed in U.S. Pat. No. 3,225,510 which have been running containers of the type which is shown in U.S. Pat. No. 3,176,902. Those prior art containers have divider tabs located approximately in the position where the holes 72 are located. Star wheels under the path of the cartons are adapted to swing up and raise those tabs. Since in the present invention those tabs do not exist, the holes 72 are provided so that the projecting fingers of the star wheels will not engage and dislodge the containers.

The flat blank of FIG. 3 must be folded and glued into a flat-folded blank adapted to be run on the machine of U.S. Pat. No. 3,225,510. The first step in the gluing/folding operation is to apply glue to the tabs 62, 63 and 64 as indicated by the stippling 75 in FIG. 4. The blank of FIG. 3 is shown with the printed side facing down. In FIG. 4, the next step is shown wherein the second section 48 is folded over upon the first section 47 along the crease 49 so that the printed side of the second section is now facing up.

Figure 5:
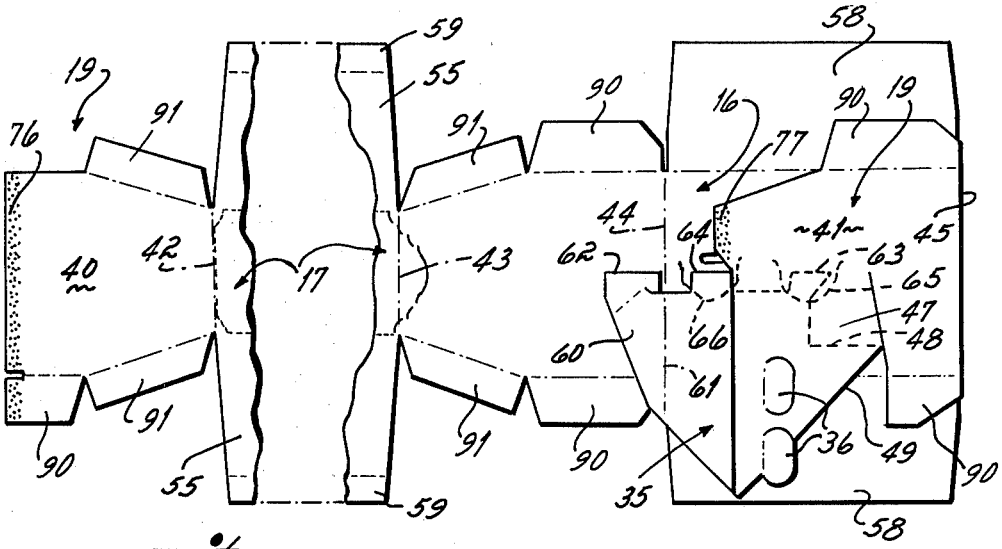
FIG. 5 is a view similar to FIG. 4 showing a second step in the formation of the container.

As shown in FIG. 5, the next step involves the folding over of the lower portion 41 onto the bottom wall along crease 45. When that fold is made, the glue tabs 63 and 64 will match up with the bottom glue tabs 65 and 66, respectively. Similarly, the glue tab 62 will overlie a small portion of the end wall 18 adjacent its crease 44.

Figure 6:
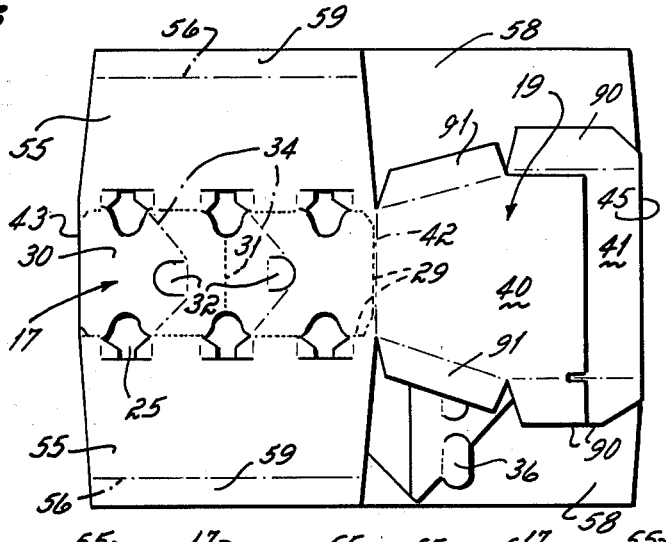
FIG. 6 is a view similar to FIG. 4 showing the final step in the formation of the flat-folded blank prior to its being run on a container-loading machine.

In the next step, glue is applied to the upper portion 40 of the end wall 19 along its free edge, as indicated by the stippling 76. Then that upper portion 40 and top wall 17 are folded over upon the end wall 18 and bottom wall 16 along crease line 43 as shown in FIG. 6. The glue along the stipple line 76 causes the upper portion 40 to adhere to the lower portion 41, thereby forming the complete end wall 19. Glue may also be applied on the printed side of the stippled portion 77 of lower portion 41 to provide an additional glued joint between the upper and lower portions 40 and 41, respectively. Pressure is applied to the glued areas for a sufficient length of time to provide good adhesion, thereby completing the formation of the flat-folded blank as it appears in FIG. 6.

BOTTOM WALL WITH BOTTLE DIVIDER TABS

A divider tab struck from the bottom walls is disclosed in the Wuerthner U.S. Pat. No. 3,090,520. That is a single divider tab which provides for protection against breakage but does not comply with I.C.C. regulations which require that the bottles be separated by at least 0.040 inch. The paperboard from which the containers are made is approximately 0.021 inch and therefore a double thickness of tab is needed for containers of bottles shipped in interstate commerce. U.S. Pat. No. 3,176,902 discloses a double tab set structure.

In practice, that container is erected and filled in a machine generally of the type disclosed in U.S. Pat. No. 3,225,510. In the course of loading the container, the bottom tabs are raised by a star wheel from below the container as the bottles are moved into the container from the sides. The bottom tabs are at approximately a 45° angle at the time the bottle contacts the tab to swing it to a substantially vertical orientation with respect to the bottom wall. The raw cut edge of the tab often contacts the edge of a wet bottle label during this brief period of engagement and tears or otherwise mutilates the label. Further, once the complete container is filled and closed, any rotation of bottles may also cause label damage.

In FIGS. 3 and 3A, two different divider tab structures are disclosed. The bottom structure of FIG. 3A is a suitable substitute for the bottom structure of the container of U.S. Pat. No. 3,176,902 which has no central partition serving as a container handle or in which the central partition is not connected to the bottom wall. That bottom structure of FIG. 3A is modified slightly as shown in FIG. 3 in order to accommodate the central partition internal handle which, as described above, is glued to tabs 65, 66 in the bottom wall. Referring to FIG. 3A as well as FIGS. 10–13, two slightly differing types of divider tabs are shown. The longitudinal divider 71 will form a double thickness separation of the three bottles on each side of the container along the center line of the container. A transverse divider 70 forms a double thickness separation of the adjacent bottles on each side of the container.

The divider tab 70 has a hinged element 80 (FIG. 13) which is hinged along a transverse line 81 to the bottom wall 16. A free element 82 is connected along a hinge line 83 to the hinged element 80.

The longitudinal divider tab 71 is similarly formed by a hinged element 85 which is connected along a longitudinal crease or fold line 86 which is located just slightly to one side of the center line of the container. A free element 87 is connected along hinge line 88 to the hinge element 85.

Figure 13:
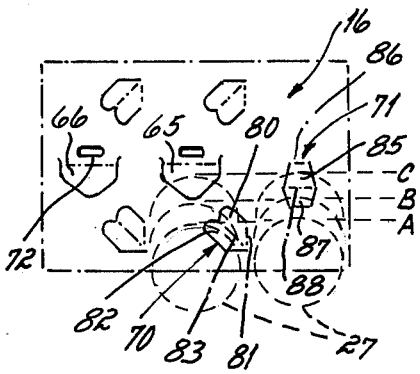
FIG. 13 is a plan view still further illustrating the manner in which the divider tabs are formed.

In FIG. 13, three positions of a bottle are illustrated at A, B and C which diagrammatically illustrate the positions which bottles pass through as they are loaded into the container. As the bottles arrive at position A, the tab 70 is raised by a star wheel from below the container. As the element 80 is raised, the element 82 engages the base of the left bottle and is folded downwardly to form the inverted V. The movement is around the radius of the bottle base and is then up the side of the bottle. At no time does a raw edge contact the bottle label.

As the left bottle continues to move to the position B, the folding of the tab 70 is completed. Meanwhile, the leading edge of the right bottle is over the element 87 of the longitudinal tab 71. The hinged element 85 of the tab 71 is raised by a star wheel. The free element 87 engages the bottom of the bottle and is folded downwardly as the bottle continues to move into the position shown at C. Again, the tab is folded around the radius at the bottom of the bottle and no raw edge contacts the bottle labels.

In the foregoing description, the movement of two bottles into the container has been described. It should be understood that three bottles move substantially simultaneously into the container from each side of the container and that each bottle, in cooperation with the star wheel raising the divider tab, will cause the respective divider tabs which the bottles engage to be projected up while simultaneously having free hinged elements folded downwardly to form an inverted V-shaped divider tab.

It also can be observed that when the container has a central partition forming an internal container handle, the bottom structure will be substantially that illustrated at 16 in FIG. 3. There, two of the longitudinal divider tabs 71 are eliminated and replaced by the bottom tabs 65 and 66, it being recalled that those tabs will be glued to tabs 63 and 64 on the central partition, thereby forming a pair of double thickness longitudinal dividers.

PACKAGING OPERATION AND USE OF THE CONTAINER

Figure 7:
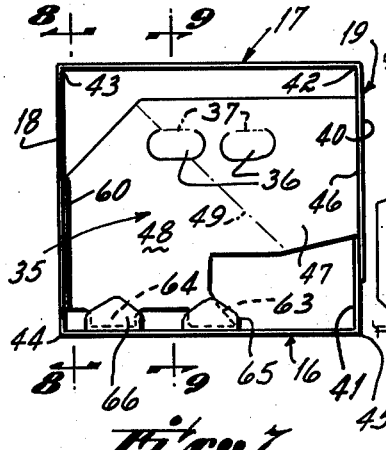
FIG. 7 is a side view looking through the center of the container when erect.
Figure 8:
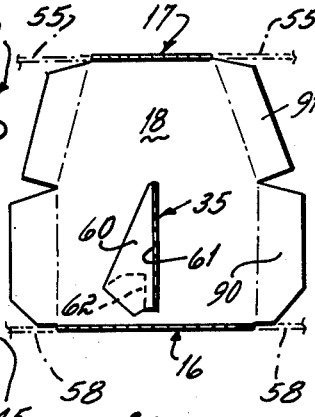
FIG. 8 is a cross-sectional view taken along lines 8—8 of FIG. 7.
Figure 9:
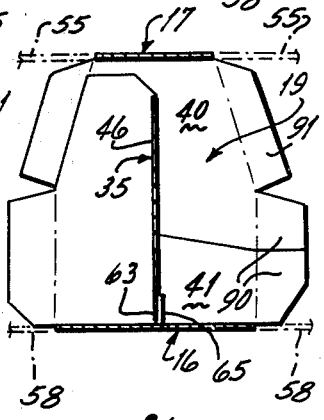
FIG. 9 is a cross-sectional view taken along lines 9—9 of FIG. 7.

The flat-folded blank is fed from a magazine of a machine of the type shown in U.S. Pat. No. 3,225,510. There it is erected to the tubular form shown in FIGS. 7 and 10, the tube having an axis in the direction of line A. In the erecting operation, the central partition 35 is snapped into the vertical attitude shown in FIG. 10 transverse to the axis A. Thereafter, as the container continues to move down the machine, three bottles are slid from either side of the container into the container engaging the divider tabs 70 and 71 to erect them to the vertical double-thick position in the manner previously described.

Figure 10:
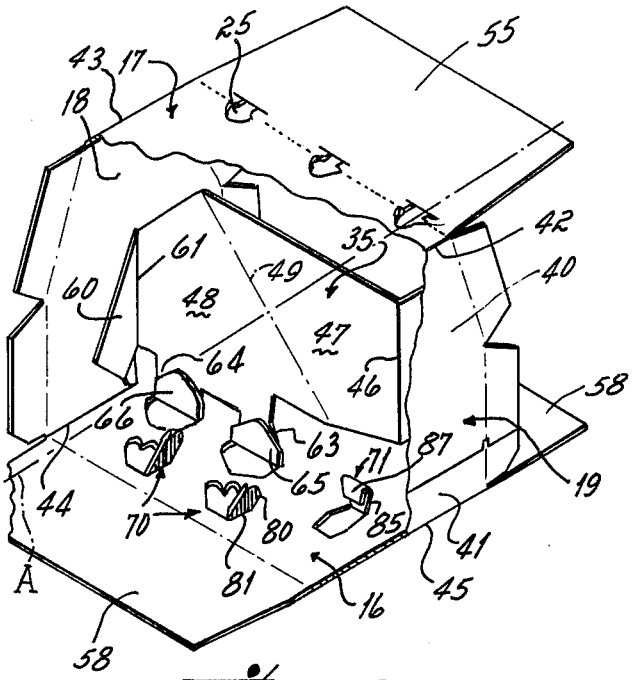
FIG. 10 is a perspective view with portions broken away illustrating the manner in which the container is loaded to form the divider tabs.
Figure 11:
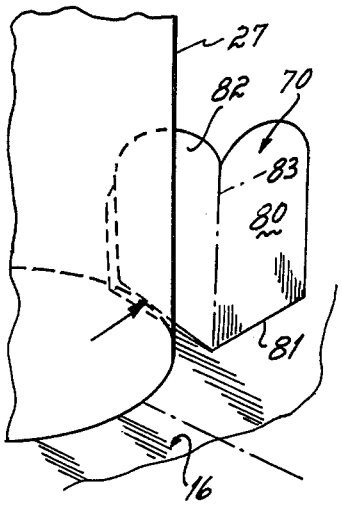
FIGS. 11 and 12 are enlarged fragmentary, perspective views further illustrating the manner in which the divider tabs are formed during the loading of the container.
Figure 12:
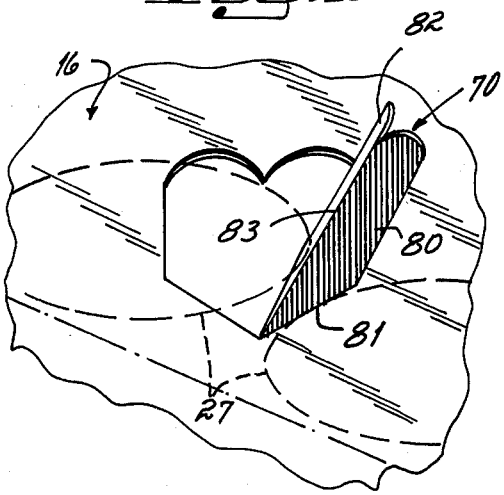

As can be seen from FIGS. 3 and 10, the end walls 18 and 19 each have lower glue flaps 90 and upper flaps 91. After bottles have been side loaded into the container, glue is applied to the areas 91 and 93 on the lower glue flaps 90 and to the areas 94 on the lower side flaps 58. The lower and upper flaps 90 and 91 are plowed inwardly to lie across the sides of the container. The lower side flaps are plowed upwardly with their end portions engaging and being pressed against the lower glue flaps and particularly the areas 92 and 93 where glue is applied.

The upper side flaps 55 are plowed down onto and lie against the inwardly-folded upper tabs 91. The lower edge 59 of each upper side flap engages the glue line 94 on each lower side flap 58 and is pressed against it to cause the glue to adhere. This completes the formation of the container with the bottles inside.

The customer carries the package of bottles from the store by projecting thumb and finger through the finger hole tabs 32. When the contents are to be consumed, the central portion 30 of the top wall 17 is ripped away so that the container appears as depicted in FIG. 2. With the open top, the bottles can easily be removed from the container and replaced when the contents are consumed.

It can be seen from FIG. 2 that the central partition 35 is available for gripping through the holes created by tabs 36 in the upper edge portion thereof, thereby enabling the consumer to carry the bottles back to the store in the same container in which they were purchased.

THE LAYOUT FOR CUTTING BLANKS FROM A WEB

Figure 14:
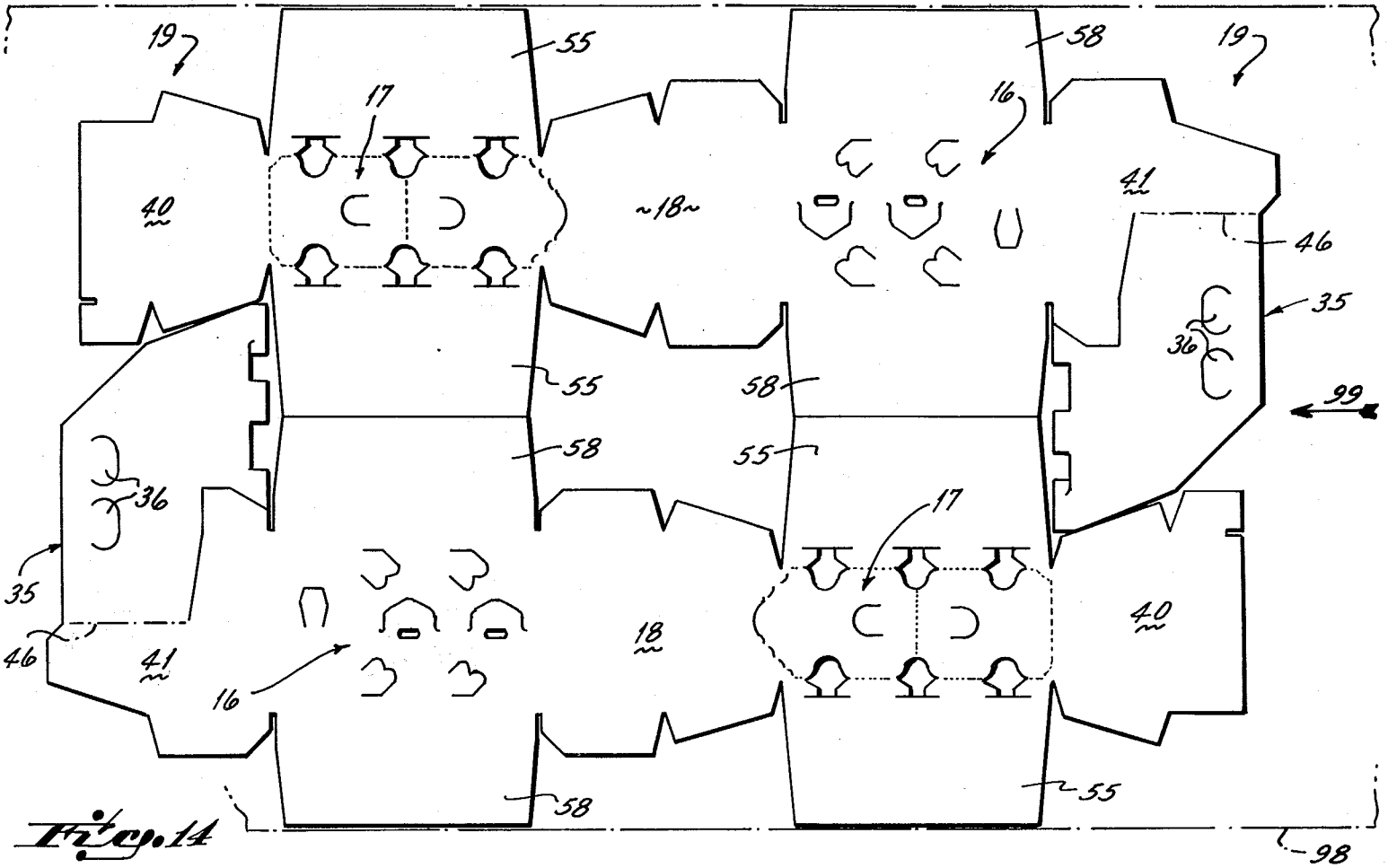
FIG. 14 is a plan view illustrating the nesting relationship between reversed blanks as they are cut from a web.

The configuration of the central partition 35 and the manner in which it is connected along crease 46 to the lower portion 41 of end wall 19, coupled with the configuration of the upper portion 40 of the end wall 19, admits of economies in the laying out of the blanks for cutting from the web. As shown in FIG. 14, a web 98 is run in the direction of the arrow 99. The blanks cut from such a web are laid out so that adjacent blanks have a reverse orientation with respect to one another. With this reversed orientation, the portion of the central partition 35 which projects beyond the outline of the upper and lower side flap members 58 and 59 can be positioned adjacent to and cut from the board lying adjacent to the upper portion 40 of the end wall 19. There is therefore very little board wasted in the cutting of the blanks for the instant invention.

I claim:

1. A returnable container for glass bottles and capable of being side loaded comprising,
a bottom wall,
end walls hinged to said bottom wall,
a top wall hinged to the end walls,
said bottom wall, top wall and end walls forming a tube having an axis through it,
a pair of lower side flaps hinged to said bottom wall,
a pair of upper side flaps hinged to said top wall,
a single thickness central partition extending between end walls in a plane transverse to the axis of the tube, said partition being connected to at least two of said end walls and bottom wall to form a handle suitable for carrying empty bottles after said top wall has been opened.

2. A returnable container as in claim 1 in which said central partition has a diagonal crease which enables said container to be flat-folded and preglued as a tube with said partition glued to said bottom wall.

3. A returnable container as in claim 1 in which said partition is connected to both end walls and said bottom wall.

4. A returnable container as in claim 1 in which said partition is connected only to said end walls.

5. A returnable container as in claim 1 in which said partition is connected to one end wall and said bottom wall.

6. A returnable container as in claim 1 in which said bottom wall has upwardly-projecting tabs, said partition being glued to said tabs in the area where bottles would normally abut, whereby the combination of said tabs and partition provide double thickness of board for separating adjacent bottles.

7. A one-piece blank adapted to be glued and folded into a tube formed by a top wall, a bottom wall, two end walls and a central partition extending between end walls comprising,
an upper portion of an end wall,
a top wall hinged on a transverse line to said upper portion,
an end wall hinged on a transverse line to said top wall,
a bottom wall hinged on a transverse line to said end wall,
a lower portion of an end wall hinged on a transverse line to said bottom wall,
a central partition having a first section hinged on a longitudinal line to the lower portion of said end wall and a second section hinged on a diagonal line to said first section,
said second section being foldable on said first section, and said lower portion being foldable on said bottom wall to bring said second section into engagement with said bottom wall for gluing to said bottom wall.

8. A layout of blanks to be cut from a paperboard web, said blanks having the elements as set forth in claim 7,
said top wall and bottom wall having side wall forming flaps projecting laterally therefrom,
said end wall upper portion being narrower than said top wall, bottom wall and flaps projecting therefrom,
said blanks being laid out alternately in reverse orientation whereby to cut the projecting second section from paperboard located adjacent said upper portion of said end wall.

9. The container as in claim 1, further comprising,
a perforation line defining a central portion in said top wall,
said central portion being removable to expose the contents within the container as well as said central partition.

10. The container as in claim 1 further comprising,
said container being adapted to be side loaded with bottles on both sides of said partition and said side flaps glued together to enclose said bottles within said container,
a perforation line defining a central portion in said top wall,
said central portion being removable to convert said enclosed container to a basket type container utilizing said central partition as a handle.

11. The container as in claim 10 further comprising,
small webs outside said perforation line interconnecting said end walls and said upper side flaps,
whereby, as said central portion is torn away from said top wall, said side flaps and end walls will remain substantially erect.

12. In a tubular container for bottles in longitudinal rows on each side of said container, said container having interconnected top, bottom and end walls, said container being adapted to be loaded from the sides, first and second groups of bottle dividers formed out of the bottom wall to separate bottles longitudinally and transversely, each bottle divider comprising,
a first element hinged to and struck from the bottom wall,
a free element hinged to said first element and foldable onto said first element,
said first element being swingable to a vertical position with free element folded downwardly whereby said two elements combine to form a double thickness bottle separator.

13. A tubular container for bottles as in claim 12 in which said first element of one group of dividers is hinged on a transverse crease to separate adjacent bottles which are in a longitudinal row and in which said first element in another group of dividers is hinged on a longitudinal crease at approximately the center of the container to separate bottles on each side of said container.

14. A tubular container for bottles as in claim 13 in which the free elements of said first group of dividers are hinged on diagonal lines to respective first elements.

15. In a tubular container for bottles having interconnected top, bottom and end walls adapted to be loaded from the sides, said bottom wall having a plurality of foldable dividers partially cut from and hinged to the bottom wall, each divider having a first element hinged to said bottom wall and a free element hinged to said first element, the method of erecting said divider comprising the steps of,
sliding a bottle over said bottom wall and onto said free element,
pushing said divider, adjacent its hinge line, upwardly so as to begin to fold said divider into an inverted V,
and continuing to slide said bottle over said bottom wall in contact with said free element to complete the erection of said divider to a substantially vertical attitude, thereby forming a double thickness divider without subjecting the surface of said bottle to abrasion by a raw cut edge of a divider.

* * * * *